US008152140B1

(12) United States Patent
Ouellette et al.

(10) Patent No.: US 8,152,140 B1
(45) Date of Patent: Apr. 10, 2012

(54) FLAT BELT CLAMPING PULLEY

(75) Inventors: Joseph F. Ouellette, Glendale, MO (US); Richard J. Ouellette, Glendale, MO (US)

(73) Assignee: Ouellette Machinery Systems, Inc., Fenton, MO (US)

( * ) Notice: Subject to any disclaimer, the term of this patent is extended or adjusted under 35 U.S.C. 154(b) by 0 days.

(21) Appl. No.: 12/889,754

(22) Filed: Sep. 24, 2010

(51) Int. Cl.
*B66D 1/26* (2006.01)

(52) U.S. Cl. ..... 254/278; 254/371; 254/373; 242/579; 242/587.1

(58) Field of Classification Search ..... 254/278, 254/371, 372, 373, 374, 393; D8/360; 242/579, 242/587, 587.1, 587.2, 587.3
See application file for complete search history.

(56) References Cited

U.S. PATENT DOCUMENTS

| | | | | | |
|---|---|---|---|---|---|
| 1,408,425 | A * | 2/1922 | Passavanti | ..... | 242/587.3 |
| 2,329,943 | A * | 9/1943 | Robins | ..... | 242/587.1 |
| 4,254,921 | A * | 3/1981 | Adomeit | ..... | 242/376 |
| 4,412,661 | A * | 11/1983 | Wise et al. | ..... | 242/614.1 |
| 5,167,378 | A * | 12/1992 | Johanson | ..... | 242/586.2 |
| 5,957,433 | A * | 9/1999 | Fujikawa et al. | ..... | 254/371 |
| 6,202,957 | B1 * | 3/2001 | Bannert et al. | ..... | 242/587.1 |
| 6,491,246 | B1 * | 12/2002 | North et al. | ..... | 242/332.8 |
| 6,732,966 | B2 * | 5/2004 | Wier | ..... | 242/376 |
| 7,108,248 | B2 * | 9/2006 | Winter et al. | ..... | 254/371 |
| 7,392,973 | B1 * | 7/2008 | Hsieh | ..... | 254/218 |
| 7,490,790 | B1 * | 2/2009 | Gruber et al. | ..... | 242/322 |
| 7,549,602 | B2 * | 6/2009 | Inugai et al. | ..... | 242/348 |
| 2003/0146336 | A1 * | 8/2003 | Imai | ..... | 242/579 |
| 2005/0205713 | A1 * | 9/2005 | Ripplinger | ..... | 242/608 |

OTHER PUBLICATIONS

Contitech Ag; Continental ContiTech Conti Polyflat PU Belts; Issued Feb. 2010.

* cited by examiner

*Primary Examiner* — Emmanuel M Marcelo
(74) *Attorney, Agent, or Firm* — Joseph M. Rolnicki; Evans & Dixon, LLC

(57) ABSTRACT

A flat belt clamping pulley securely clamps the end of a flat belt to the pulley without requiring fastener holes being provided through the end of the flat belt. The design of the flat belt clamping pulley enables the pulley to be economically constructed without requiring difficult or troublesome machining steps.

21 Claims, 12 Drawing Sheets

FLAT BELT CLAMPING PULLEY

BACKGROUND OF THE INVENTION

1. Field of the Invention

The present invention pertains to a flat belt pulley that securely clamps a flat belt to the pulley.

2. Description of the Related Art

High strength, limited stretch flat belts are often used in heavy load lifting and lowering applications. Examples of applications in which flat belts are used include belt and pulley drive systems that lift and lower heavy objects such as, elevator belt and pulley drive systems, fork lift belt and pulley drive systems and weight lifting apparatus belt and pulley drive systems. These types of flat belts are typically manufactured in open lengths with one end of the length being clamped to a drive pulley and the opposite end of the length being clamped to the object being lifted and lowered. The high strength and limited stretch properties of the flat belts are achieved by constructing the belts of a plurality of steel cords positioned side by side along the belt length. Each steel cord is constructed of multiple wound steel strands and the plurality of cords are encapsulated in a polyurethane resin.

The drive pulley to which one end of the flat belt is clamped is typically a flat-faced pulley with side flanges. The spacing between the side flanges is generally slightly larger than the width of the flat belt to ensure that the side flanges guide the flat belt and align each wrap of the flat belt on the pulley.

Flat belt pulleys are also designed with a special center hub that is constructed of two pieces with there being opposed, flat clamping surfaces on the two pieces of the hub. The two pieces of the hub include a large piece and a small piece, where the large piece includes the pulley shaft center bore. The small piece is clamped to the large piece with one end of the flat belt clamped between the opposed clamping surfaces of the two pieces of the hub.

In prior art clamping pulley constructions, the large piece and small piece of the pulley hub are typically clamped together by threaded fasteners. Fastener holes extend through the small piece of the pulley hub and align with internally threaded fastener holes in the large piece of the pulley hub. The fastener holes also extend through the opposed clamping surfaces of the pulley hub. It is therefore necessary that, when attaching one end of the flat belt to the pulley between the opposed clamping surfaces, holes must be provided through the end of the flat belt that align with the fastener holes in the pulley large piece and the fastener holes in the pulley small piece. Fasteners can then be inserted through the fastener holes in the pulley small piece, through the aligned holes provided in the belt end, and into the fastener holes of the pulley large piece. Tightening the fasteners then clamps the pulley small piece to the pulley large piece with the belt end positioned therebetween, thereby clamping the belt end to the pulley.

The need to provide fastener holes through the belt end being secured to the clamping pulley detracts from the strength of the flat belt by removing material from the end of the flat belt. Each fastener hole made through the end of the flat belt will at least remove some polyurethane from the end of the flat belt, and could also potentially cut through one or more of the steel cords reinforcing the end of the flat belt. Therefore, prior art flat belt clamping pulleys are disadvantaged in that they reduce the tensile strength of the end of the flat belt clamped to the pulley.

SUMMARY OF THE INVENTION

The flat belt clamping pulley of the present invention overcomes the above-described disadvantage of prior art flat belt pulleys by providing a clamping pulley that securely clamps the end of a flat belt to the pulley without requiring fastener holes through the end of the flat belt. Furthermore, the design of the flat belt clamping pulley of the invention enables the pulley to be economically constructed without requiring difficult or troublesome machining steps.

The flat belt clamping pulley of the invention is basically comprised of a cylindrical center hub and a pair of circular flanges attached to the opposite sides of the center hub. In the preferred embodiment, the center hub and the flanges are all constructed of aluminum, for ease of machining of the pulley.

The center hub has a two-piece construction including a first, large piece and a second, small piece. The large piece of the hub includes the shaft hole for the pulley. The large piece and small piece have clamping surfaces that oppose each other. The large piece and small piece are clamped together with an end of the flat belt between the clamping surfaces while securely clamping the belt end to the pulley.

At least two adjustable fasteners connect the hub large piece to the hub small piece. The adjustable fasteners are positioned on the hub on axially opposite sides of the belt when the belt end is securely clamped between the clamping surfaces of the hub.

Cavities are recessed into the opposite sides of the hub large piece. A pair of parallel grooves are also formed in the opposite sides of the hub large piece. The pairs of grooves intersect with the cavities in each side of the hub large piece and also intersect with the clamping surface of the hub large piece. The spacing between the grooves on opposite sides of the clamping surface is slightly larger than the width of the flat belt.

Steel rods extend through the hub large piece. The steel rods have flat side surfaces at their opposite ends and holes through their opposite ends that intersect and are perpendicular to the flat surfaces. The holes through their opposite ends align with the grooves in the opposite sides of the hub large piece.

Internally threaded fastener holes are provided in the clamping surface of the hub small piece. The internally threaded holes align with the grooves formed in the opposite sides of the hub large piece.

Adjustable fasteners extend through the holes in the opposite ends of the steel rods, through portions of the grooves formed in the hub large piece, and then into the internally threaded holes of the hub small piece. The heads of the fasteners are positioned in the cavities in the opposite sides of the hub large piece. The fastener heads are accessible by a T-shaped Allen wrench through the grooves on the opposite sides of the hub large piece to initially tighten the fasteners, and then by an L-shaped Allen wrench having its short end positioned in the cavity for further tightening of the adjustable fasteners. The grooves in the opposite sides of the hub large piece and the internally threaded holes in the clamping surface of the hub small piece have a sufficient spacing therebetween to allow the end of the belt to be positioned between the clamping surfaces of the hub large and small pieces and between the adjustable fasteners positioned in the grooves and threaded holes. Tightening the adjustable fasteners clamps the end of the belt between the opposed clamping surfaces of the hub large and small pieces and securely clamps the belt to the pulley.

The first and second circular flanges that are attached to the opposite sides of the center hub have opposing interior surfaces with each interior surface having a circular cavity recessed into the surface. The circular cavities in the flange interior surfaces receive the opposite sides of the center hub when the flanges are attached to the center hub. The circular cavities of the flanges are dimensioned so that the flanges overlap or extend around the adjustable fasteners on the center hub. This positions the fasteners on the opposite sides of the center hub within the cavities in the flange interior surfaces when the flanges are attached to the center hub. This also positions the opposing interior surfaces of the flanges apart by a distance that is only slightly larger than the width of the flat belt.

The above-described clamping pulley of the invention overcomes shortcomings of prior art clamping pulleys by enabling a flat belt end to be securely clamped to the pulley without requiring fastener holes through the belt end. Furthermore, the unique construction of the pulley enables manufacturing the pulley while avoiding difficult and troublesome machining operations.

BRIEF DESCRIPTION OF THE DRAWINGS

Further features of the flat belt clamping pulley of the invention are set forth in the following detailed description of the invention and in the drawing figures.

DETAILED DESCRIPTION OF THE PREFERRED EMBODIMENT

Figure 1:
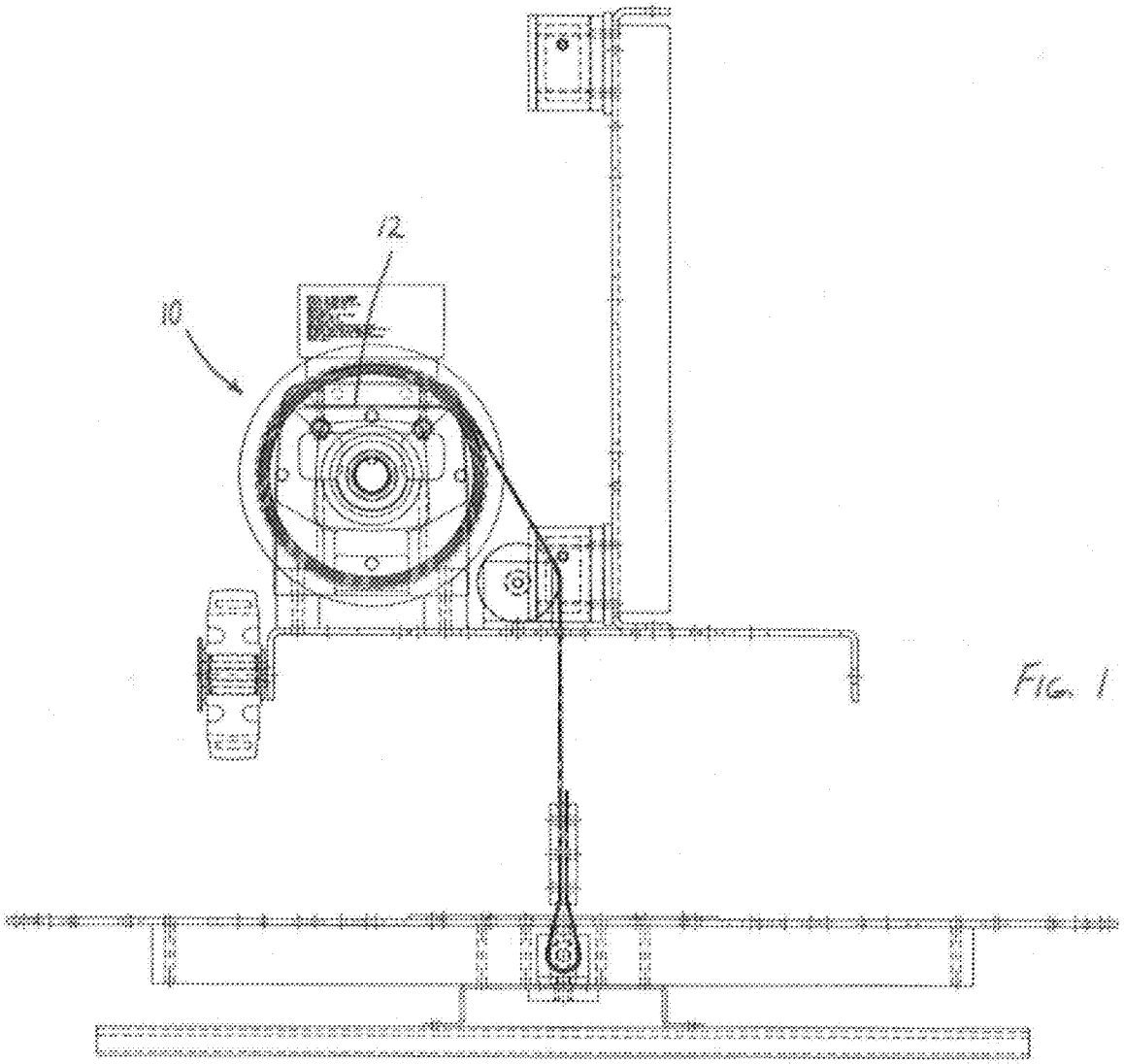
FIG. 1 is a side elevation view of an example of an operative environment of the belt clamping pulley of the invention.

The flat belt clamping pulley 10 of the present invention is specifically designed to be securely clamped to an end of a flat belt 12 without compromising or reducing the tensile strength of the belt by making holes through the end of the belt for fasteners or other means of securing the end of the belt to the pulley. The pulley 10 of the invention is basically comprised of a center hub 14 and first 16 and second 18 circular flanges that are attached to the opposite sides of the hub 14. In the embodiment of the pulley 10 described herein, the hub 14 and the pair of flanges 16, 18 are constructed of aluminum. Aluminum is preferred for ease of machining of the hub 14 and flanges 16, 18. In alternate embodiments of the pulley 10, other materials could be employed.

The pulley center hub 14 has a two-piece construction shown in FIGS. 6-12. The two-piece construction includes a first, large piece 14*a* and a second, small piece 14*b*. Together, the two pieces 14*a*, 14*b* give the hub 14 a cylindrical configuration defined by a cylindrical peripheral surface of the hub. The hub peripheral surface is comprised of first 22*a* and second 22*b* portions of the peripheral surface on the respective large 14*a* and small 14*b* pieces of the hub. The hub peripheral surface has an axial width dimension that is larger than the width dimension of the flat belt 12. The hub 14 has a center shaft hole 24 in the hub large piece 14*a*. The center shaft hole 24 has a center axis 26 that defines mutually perpendicular axial and radial directions relative to the pulley 10. The hub 14 has circular surfaces on axially opposite sides of the hub. One of the circular surfaces is comprised of first 28*a* and second 28*b* surface portions on the respective large 14*a* and small 14*b* pieces of the hub. The opposite circular surface is comprised of first 32*a* and second 32*b* surface portions on the respective large 14*a* and small 14*b* pieces of the hub.

The large piece 14*a* of the hub has a flat, first clamping surface 38. The first clamping surface 38 opposes a second, flat clamping surface 42 on the small piece 14*b* of the hub. As seen in the drawing figures, the clamping surfaces 38, 42 are positioned to one side of the hub center axis 26. The opposed clamping surfaces 38, 42 also have width dimensions that are larger than the width dimension of the belt 12. The opposed clamping surfaces 38, 42 are provided on the hub 14 to securely clamp an end of the belt 12 between the clamping surfaces 38, 42 and thereby securely clamp the end of the belt to the pulley 10 without requiring fastener holes through the belt. To further secure the belt 12 to the pulley 10, after the end of the belt is secured between the opposed clamping surfaces 38, 42, the belt is wrapped one or more times around the pulley center hub 14 to further increase the tension force that can be exerted by the belt 12 secured to the pulley 10.

A pair of first, generally rectangular cavities 44, 46 are recessed into the first surface portion 28*a* on the one side of the hub large piece 14*a*. The first 44 and second 46 cavities have respective bottom walls 44*a*, 46*a* at the bottoms of the cavities and respective side walls 44*b*, 46*b* that extend around the bottom walls and define the cavities.

A second pair of cavities 48, 52 are recessed in the first surface portion 32*a* on the opposite side of the hub 14. The second pair of cavities 48, 52 are axially opposite the first pair of cavities 44, 46 and have the same configurations as the first pair of cavities. The second pair of cavities 48, 52 have respective bottom walls 48*a*, 52*a* and respective side walls 48*b*, 52*b* that extend around the bottom walls and define the cavities.

A pair of straight, parallel grooves 54, 56 are formed in the first surface portion 28*a* on the one side of the hub large piece 14*a*. As seen in the drawing figures, the pair of grooves 54, 56 intersect the first cavities 44, 46 and are perpendicular to the clamping surface 38 of the hub large piece 14*a*.

A similar pair of grooves 58, 62 are formed in the first surface portion 32*a* on the other side of the hub large piece 14*a*. The second pair of grooves 58, 62 are also straight, parallel grooves that intersect the cavities 48, 52 in the first surface portion 32*a* on the other side of the hub large piece 14*a* and are perpendicular to the clamping surface 38 of the hub large piece 14*a*.

A first pair of straight, parallel internally threaded screw holes 64, 66 are provided through the hub small piece 14*b*. The holes 64, 66 have center axes 64*a*, 66*a* that align with the centers of the first grooves 54, 56 formed in the one side 28*a* of the hub large piece 14*a*.

A second pair of straight, parallel internally threaded screw holes 68, 72 are formed through the hub small piece 14*b* on an axially opposite side of the hub small piece 14*b* from the first pair of screw holes 64, 66. The second pair of screw holes 68, 72 have center axes 68*a*, 72*a* that are parallel with the center axes 64*a*, 66*a* of the first pair of screw holes 64, 66 and are aligned with the centers of the second pair of grooves 58, 62 formed in the other side surface 32*a* of the hub large piece 14*a*.

A pair of cylindrical rod holes 74, 76 extend axially through the hub large piece 14*a*. The rod holes 74, 76 have center axes 74*a*, 76*a* that are parallel to each other and parallel to the hub center axis 26. The rod hole center axes 74*a*, 76*a* are also parallel to the opposed clamping surfaces 38, 42. As seen in the drawing figures, one of the rod holes 74 intersects portions of the first cavity 44 and second cavity 48 on axially opposite sides of the hub large piece 14*a*, and the other rod hole 76 intersects portions of the first cavity 46 and second cavity 52 on axially opposite sides of the hub large piece 14*a*.

A first cylindrical rod 78 is inserted through the first rod hole 74. The first rod 78 has holes 78*a* formed in its opposite ends. The holes 78*a* align with the first grooves 54, 58 formed in the opposite side surfaces of the hub large piece 14*a*. The rod 78 is also formed with a pair of flat surfaces 78*b* at opposite ends of the rod. The flat surfaces 78*b* are coplanar with portions of the side walls 44*b*, 48*b* of the cavities 44, 48 formed in the opposite sides of the hub large piece 14*a*.

A second rod 82, like the first rod 78, is inserted through the second rod hole 76. The second rod 82 also has holes 82*a* formed in its opposite ends. The holes 82*a* align with the grooves 56, 62 formed in the opposite side surface of the hub large piece 14*a*. The second rod 82 also has flat surfaces 82*b* formed in its opposite ends that are coplanar with portions of the side walls 46*b*, 52*b* of the cavities 46, 52 formed in the opposite sides of the hub large piece 14*a*.

First 84 and second 86 adjustable fasteners are inserted through the holes 78*a* in the opposite ends of the first rod 78, through portions of the grooves 54, 58 in the opposite side surfaces of the hub large piece 14*a*, and are screw threaded into the screw holes 64, 68 in the hub small piece 14*b*. In the preferred embodiment of the invention, the adjustable fasteners 84, 86 are allen socket head screws. The allen socket head screws 84, 86 have screw heads 84*a*, 86*a* positioned in the cavities 44, 48 formed in the opposite side surfaces of the hub large piece 14*a*. The screws 84, 86 and the center axes 84*b*, 86*b* of the screws extend through the grooves 54, 58 and through the screw holes 64, 68 and are positioned axially between the axially opposite side surfaces 28*a*, 28*b*, 32*a*, 32*b* of the two pieces of the hub. The screw heads 84*a*, 86*a* seat against the flat surfaces 78*b* on the opposite ends of the first rod 78.

Third 88 and fourth 92 adjustable fasteners are inserted through the holes 82*a* in the opposite ends of the second rod 82, through portions of the grooves 56, 62 in the opposite side surfaces of the hub large piece 14*a*, and are screw threaded into the screw holes 66, 72 in the hub small piece 14*b*. In the preferred embodiment, the third 88 and fourth 92 adjustable fasteners are also alien socket head screws. The heads 88*a*, 92*a* of the screws seat against the flat surfaces 82*b* on the opposite ends of the second rod 82 and are accessible in the cavities 46, 52 in the opposite side surfaces of the hub large piece 14*a*. The screws 88, 92 and the center axes 88*b*, 92*b* of the screws extend through the grooves 56, 62 and through the screw holes 66, 72 and are positioned axially between the axially opposite side surfaces 28*a*, 28*b*, 32*a*, 32*b* of the two pieces of the hub.

The axial spacing between the first and second adjustable fasteners 84, 86 and the axial spacing between the third 88 and fourth 92 adjustable fasteners is sufficient to position the end of the flat belt axially between the fasteners when the belt end is positioned between the hub clamping surfaces 38, 42. With the end of the belt so positioned, tightening the fasteners 84, 86, 88, 92 in their respective screw holes 64, 68, 66, 72 moves the first 38 and second 42 clamping surfaces toward each other and securely clamps the end of the belt between the clamping surfaces. Alternatively, loosening the fasteners 84, 86, 88, 92 in their respective screw holes 64, 68, 66, 72 moves the clamping surfaces 38, 42 apart and releases the end of the belt from between the two surfaces.

In the preferred embodiment, the two rods 78, 82 are constructed of stainless steel or some other material having a hardness greater than the hardness of the hub large piece 14*a*. This allows the rods 78, 82 and the adjustable fasteners 84, 86, 88, 92 to create a strong clamping force between the opposed clamping surfaces 38, 42 while avoiding potential damage to the aluminum hub large piece 14*a* due to the tightening of the fasteners.

A plurality of internally threaded flange mounting holes 94, 96 are provided in the one side surface 28 and the other side surface 32 of the hub large piece 14*a*, respectively. These holes 94, 96 receive threaded fasteners in attaching the first flange 16 and second flange 18 to the opposite sides of the center hub 14.

Before the flanges 16, 18 are attached to the center hub 14, the belt end 12 is secured to the pulley hub 14. With the belt end 12 positioned between the clamping surfaces 38, 42, the alien socket head screw adjustable fasteners 84, 86, 88, 92 are tightened down to secure the belt end 12 to the hub 14. This is accomplished by using a T-shaped Allen wrench. The long shank of the T-shaped Allen wrench is inserted through each groove 54, 56, 58, 62 in the opposite sides of the hub 14 to engage the Allen wrench in the heads 84*a*, 86*a*, 88*a*, 92*a* of the fasteners 84, 86, 88, 92. The fasteners 84, 86, 88, 92 are then tightened down by the T-shaped Allen wrench. The T-shaped Allen wrench is then removed from the grooves. The fasteners 84, 86, 88, 92 can then be further tightened by using an L-shaped Allen wrench. The short shank of the L-shaped Allen wrench can be inserted into the cavities 44, 46, 48, 52 and engaged in the respective screw head 84*a*, 88*a*, 86*a*, 92*a* positioned in the cavities. The L-shaped Allen wrench can then be used to further tighten down the adjustable fasteners and secure the belt end 12 between the two clamping surfaces 38, 42.

The first 16 and second 18 flanges have constructions that are mirror images of each other. Therefore, the construction of only the first flange 16 will be described in detail, with the corresponding structure of the second flange 18 being labeled with the same reference number followed by a prime (').

Each flange 16, 18 has a circular peripheral surface or edge 102, 102' with a center axis that is coaxial with the center hub axis 26. The flange peripheral surface or edge 102, 102' separates an exterior surface 104, 104' and an axially opposite interior surface of the flange. The flange exterior surface 104, 104' is substantially flat. The flange interior surface has a substantially flat center portion 108, 108' that is surrounded by a diverging surface rim 112, 112'.

A cavity 114, 114' is recessed into the flat center portion 108, 108' of the flange interior surface. The cavity has a flat bottom surface 116, 116' and a cylindrical side wall surface 118, 118' that surrounds the bottom surface 116, 116' and defines the recessed cavity. The cavity side wall surface 118, 118' is dimensioned to extend around and fit snug over axially opposite portions of the hub peripheral surface portions 22*a*, 22*b* when the flanges 16, 18 are attached to the hub 14. When the flanges 16, 18 are attached to the hub, the first 84 and third 88 alien socket head screws are positioned in the first flange cavity 114 and axially between the exterior 104 and interior 108 surfaces of the first flange 16, and the second 86 and fourth 92 alien socket head screws are positioned in the second flange cavity 114' and axially between the exterior 104' and interior 108' surfaces of the second flange 18. Additionally, when the flanges 16, 18 attached to the hub 14, the axial spacing between the opposed flat portions 108, 108' of the flange interior surfaces is just slightly larger than the axial width of the belt 12. In the preferred embodiments, the tolerance between the axial width of the belt 12 and the axial spacing between the flat portions 108, 108' of the flange interior surfaces is approximately thirty thousandths (0.030) of an inch.

Figure 2:
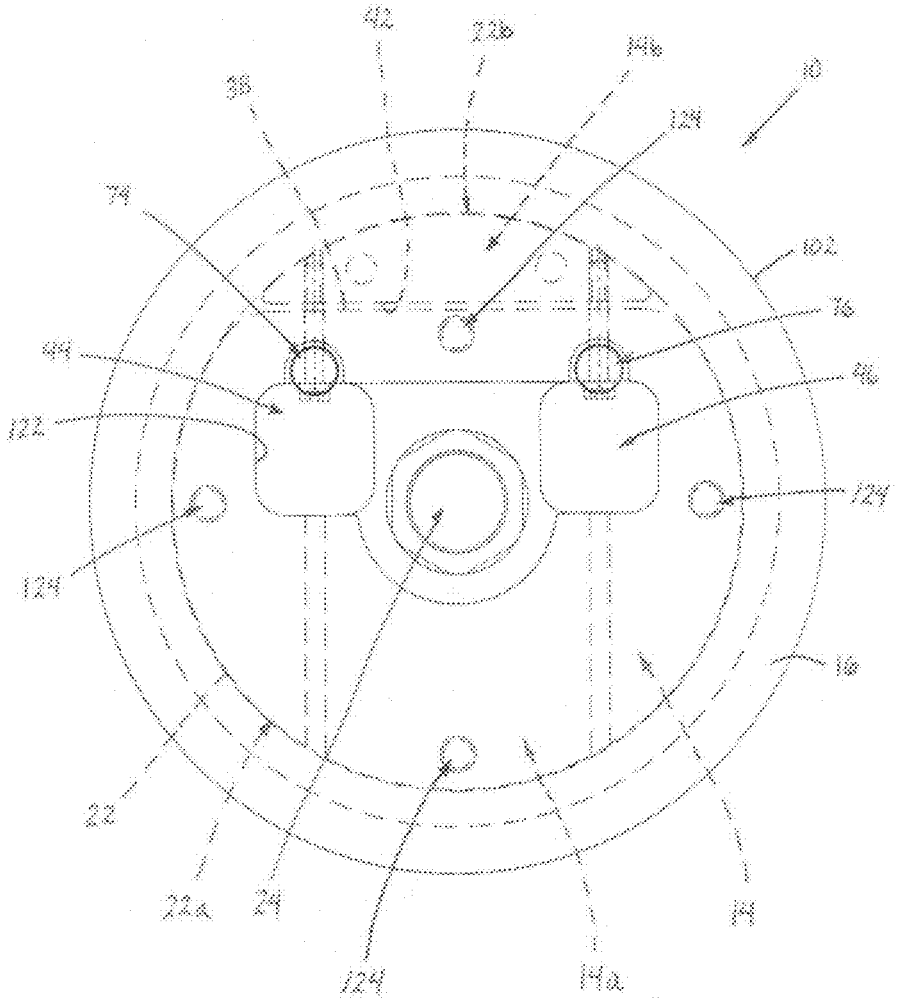
FIG. 2 is a side elevation view of one side of the pulley.
Figure 3:
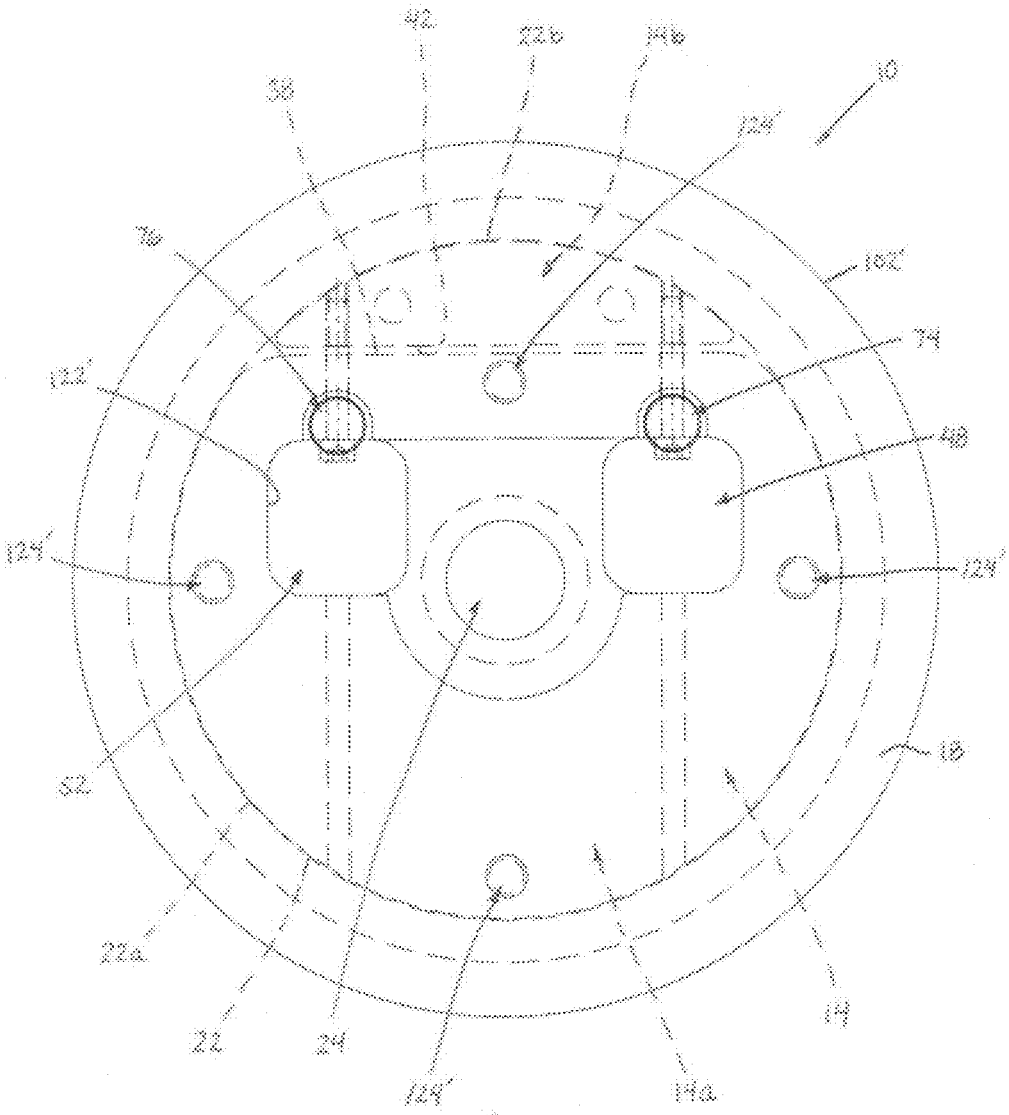
FIG. 3 is a side elevation view of the opposite side of the pulley shown in FIG. 2.
Figure 4:
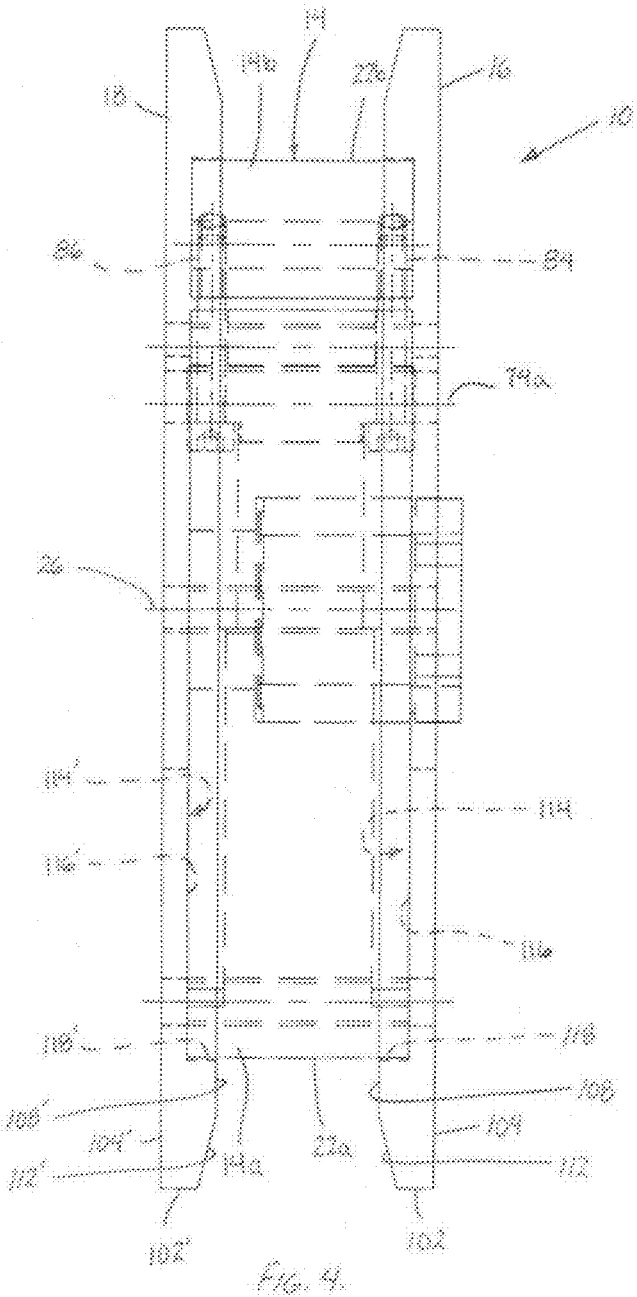
FIG. 4 is an end elevation view of the pulley from the left of the pulley as shown in FIG. 2.
Figure 5:
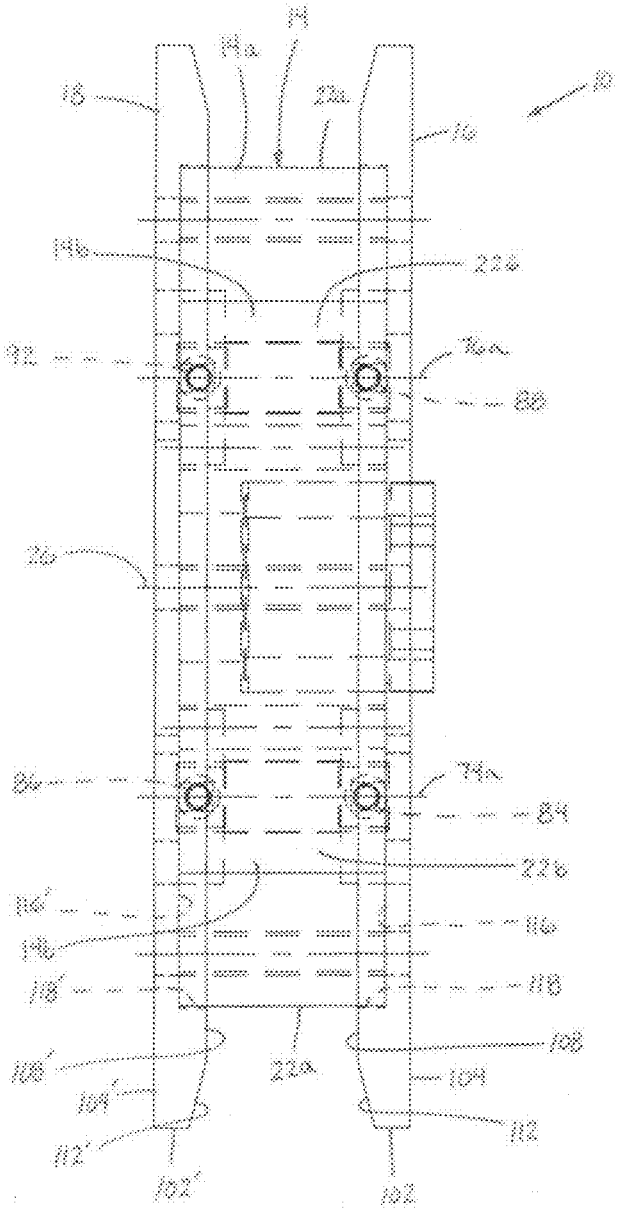
FIG. 5 is a top plan view of the pulley as shown in FIG. 1.
Figure 6:
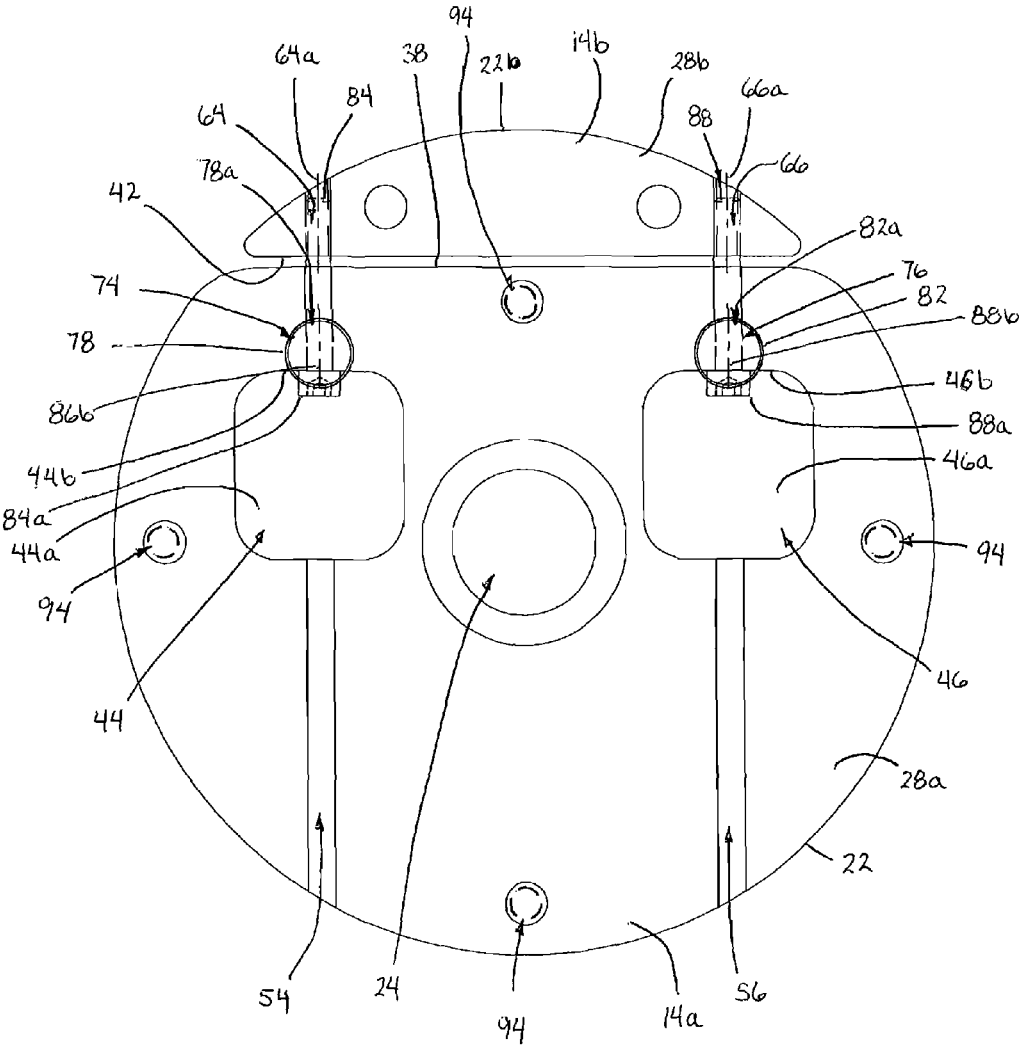
FIG. 6 is a side elevation view of the center hub of the pulley with the flanges removed.
Figure 7:
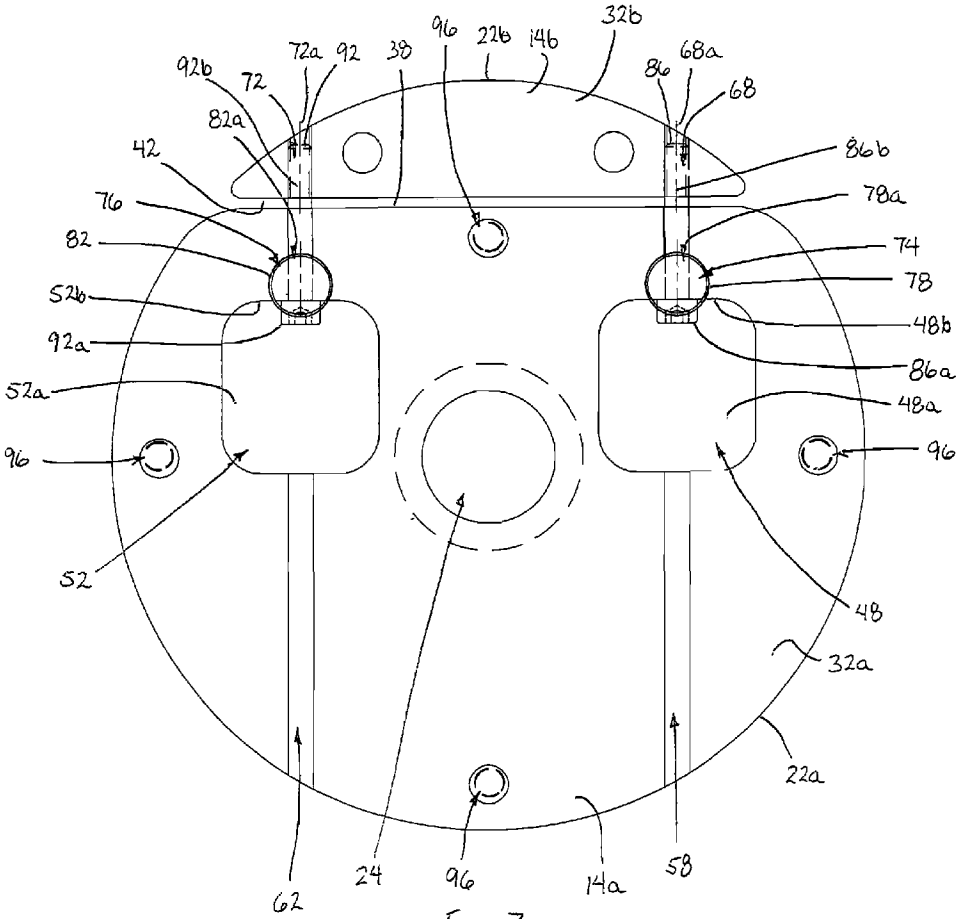
FIG. 7 is an elevation view of the opposite side of the hub shown in FIG. 6.
Figure 8:
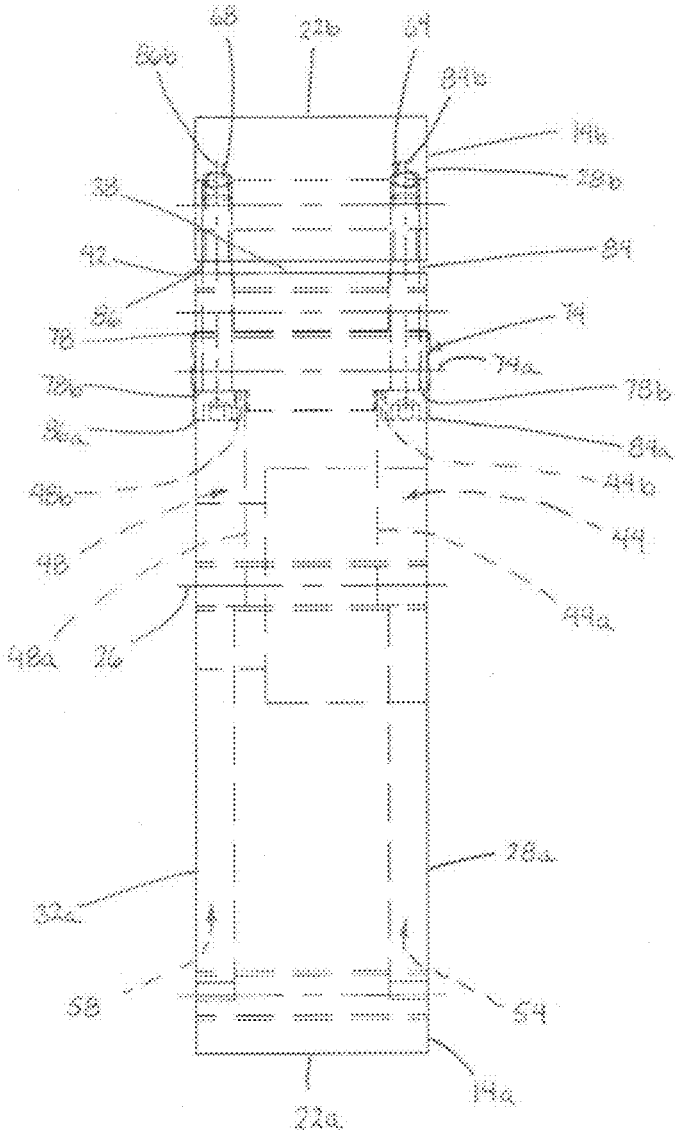
FIG. 8 is an end elevation view of the center hub from the left of the hub as shown in FIG. 6.
Figure 9:
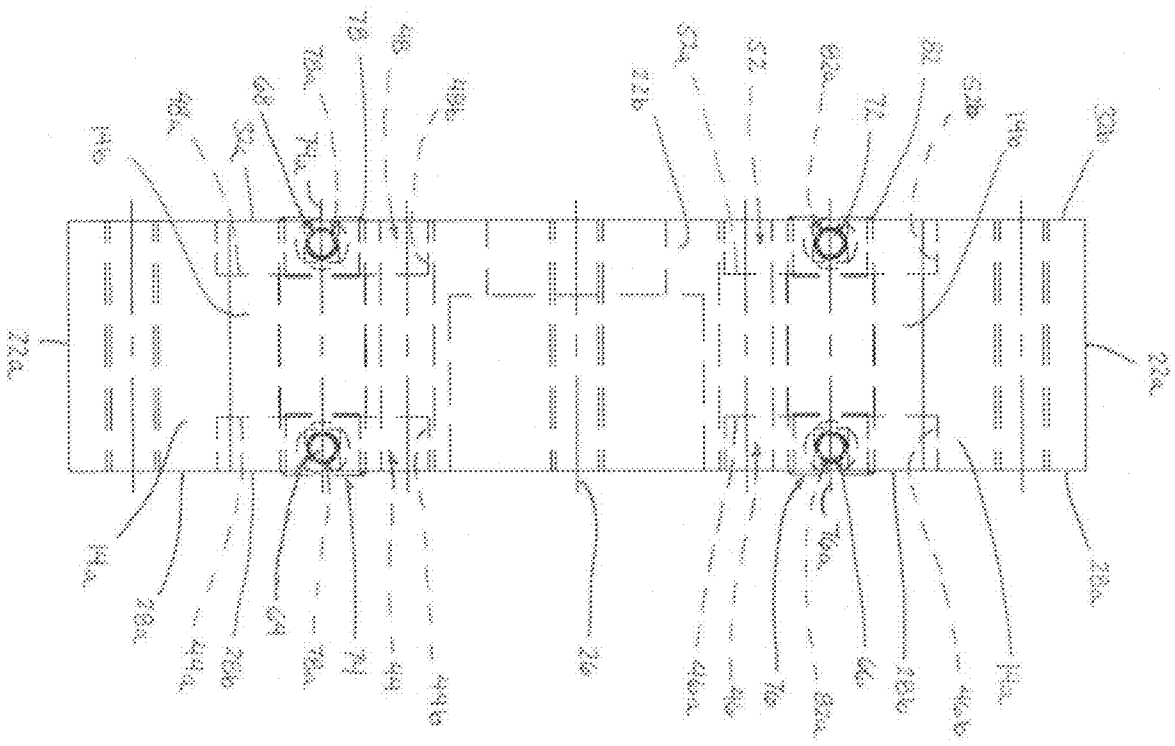
FIG. 9 is a top plan view of the center hub.
Figure 10:
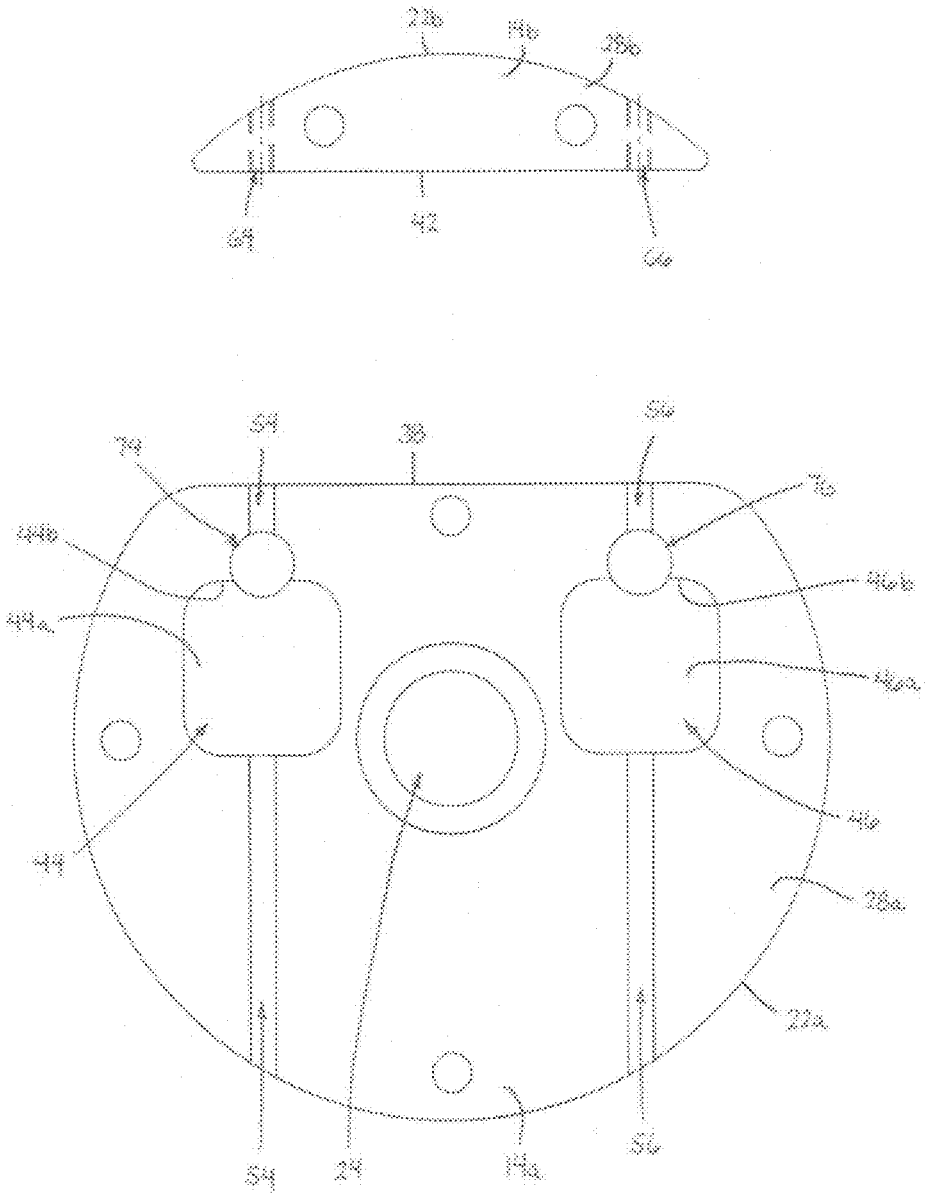
FIG. 10 is a side elevation view of the two pieces of the hub disassembled.
Figure 11:
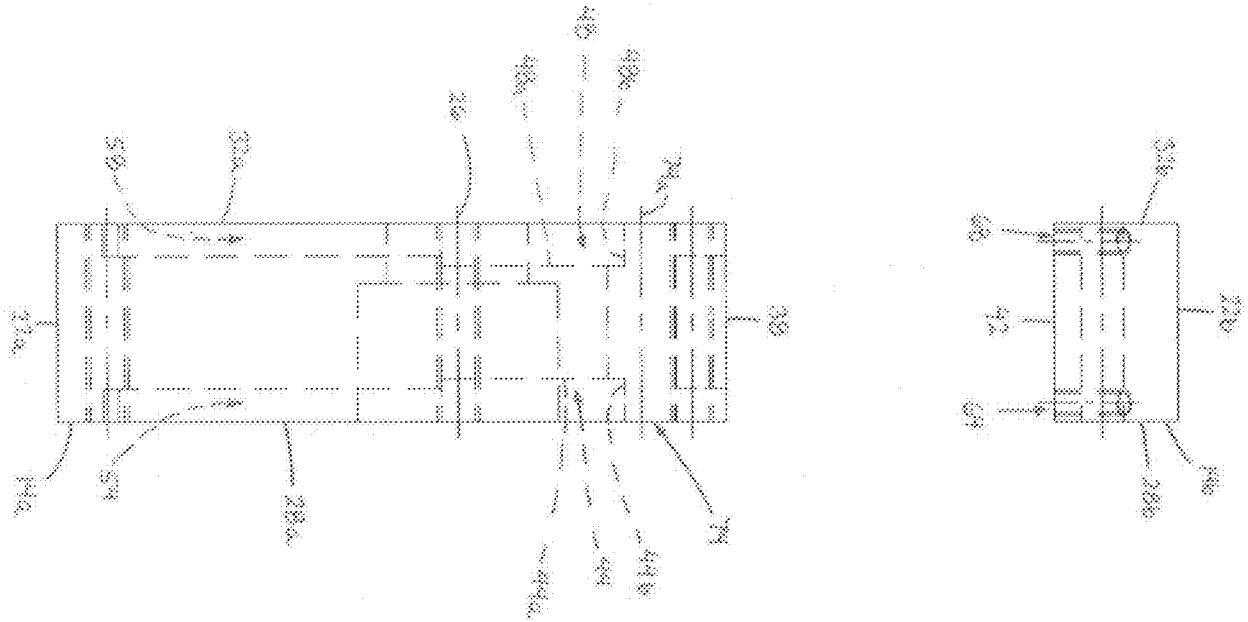
FIG. 11 is an end elevation view of the two hub pieces from the left of the hub as shown in FIG. 9.
Figure 12:
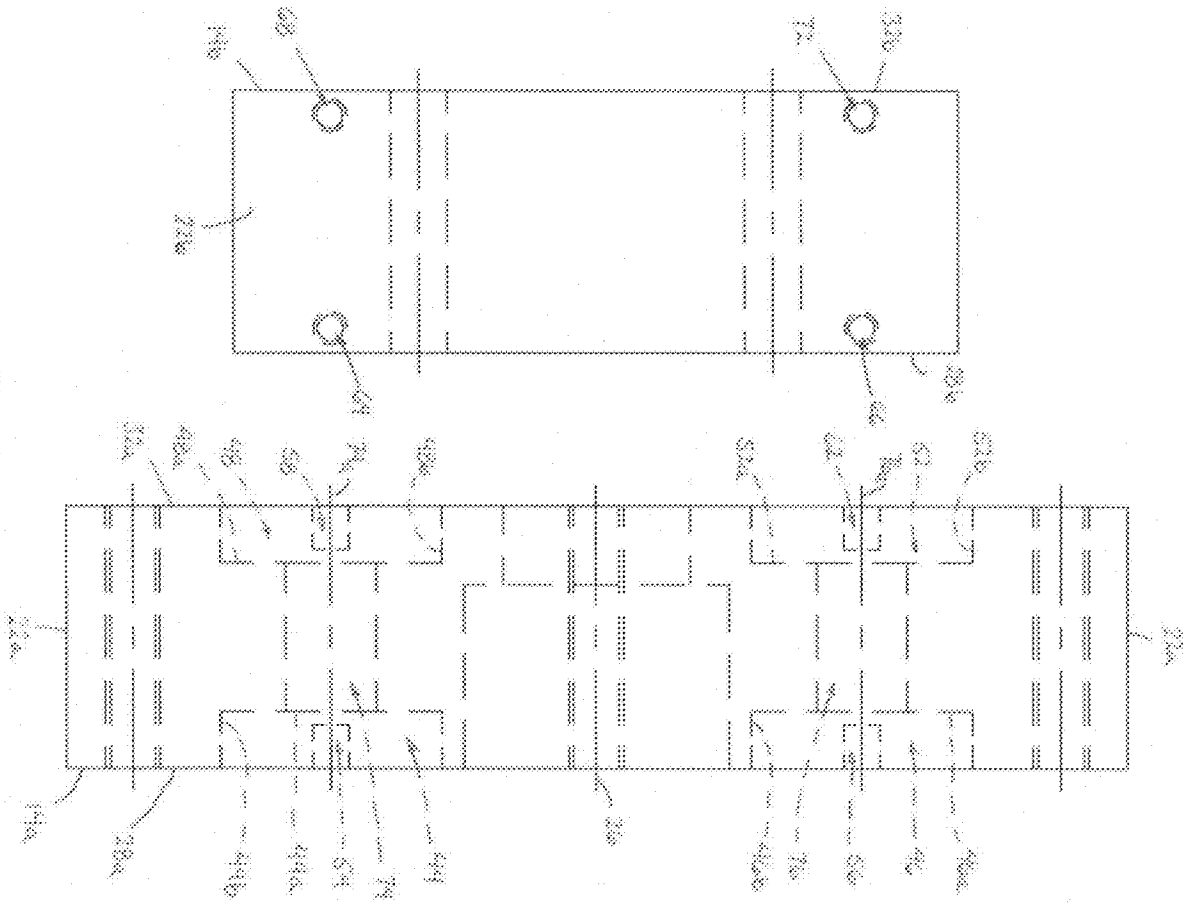
FIG. 12 is a top plan view of the two pieces of the hub disassembled.

Each of the flanges 16, 18 has a center opening through the flange defined by a side wall 122, 122' of the center opening. As seen in drawing FIGS. 2 and 3, the side walls 122, 122' of the flange openings extend around the cavities 44, 46, 48, 52 in the opposite side surfaces of the hub 14, as well as around the rod holes 74, 76 through the hub 14 and the shaft hole 24 through the hub 14. The openings through the flanges 16, 18 defined by the side walls 122, 122' provide access to the heads of the adjustable fasteners 84, 86, 88, 92 after the flanges 16, 18 have been secured to the opposite sides of the center hub 14.

The flanges 16, 18 are also provided with fastener holes 124, 124' that align with the internally threaded flange mounting holes 94, 96 in the opposite side surfaces of the hub 14. The threaded flange mounting holes 124, 124' receive threaded fasteners that are screw threaded into the threaded flange mounting holes 94, 96 in the opposite sides of the center hub 14 when attaching the flanges 16, 18 to the center hub.

The above-described clamping pulley of the invention overcomes shortcomings of prior art clamping pulleys by enabling a flat belt end to be securely clamped to the pulley without requiring fastener holes through the belt end. The recesses in the opposite interior surfaces of the pulley flanges receive those portions of the axially opposite ends of the pulley hub containing the adjustable fasteners, and thereby position the opposed interior surfaces of the flanges on the hub peripheral surface with the axial spacing between the flange interior surfaces being only slightly larger than the width dimension of the belt secured to the hub. The unique construction of the pulley with grooves provided in the opposite sides of the pulley center hub enables the threaded fasteners to be positioned on the hub clamping the two pieces of the hub together without requiring the troublesome machining operation of drilling a fastener hole completely through the two pieces of the hub.

In view of the foregoing, it will be seen that the several advantages of the invention are achieved and attained.

As various modifications could be made in the construction of the invention herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A flat belt pulley that securely clamps a flat belt to the pulley, the pulley comprising:

a two-piece hub having a center shaft hole with a center axis that defines mutually perpendicular axial and radial directions relative to the pulley, the hub having a cylindrical peripheral surface and first and second circular side surfaces on axially opposite sides of the peripheral surface, and the hub having a two-piece construction including a first piece with a first clamping surface and a second piece with a second clamping surface where the first clamping surface and the second clamping surface oppose each other with the belt there between when securely clamping the belt to the pulley;

at least two adjustable fasteners connecting the hub first piece to the hub second piece with the first and second clamping surfaces opposing each other, the adjustable fasteners enabling selective movement of the first and second clamping surfaces toward each other to securely clamp the belt between the first and second clamping surfaces and enabling movement of the first and second clamping surfaces away from each other to release the belt from between the first and second surfaces, the at least two adjustable fasteners being positioned on axially opposite sides of the belt and not through the belt when the belt is securely clamped between the first and second clamping surfaces.

2. The pulley of claim 1, further comprising:

the hub first piece being larger than the hub second piece and the center shaft hole extending through the hub first piece.

3. The pulley of claim 1, further comprising:

the first and second clamping surfaces being flat surfaces.

4. The pulley of claim 1, further comprising:

the at least two adjustable fasteners extending through both the first and second clamping surfaces.

5. The pulley of claim 1, further comprising:

a first circular flange removably secured to the hub first side surface, the first flange having a circular peripheral surface that is spaced radially outward from the hub peripheral surface; and, a second circular flange removably secured to the hub second side surface, the second flange having a circular peripheral surface that is spaced radially outward from the hub peripheral surface.

6. A flat belt pulley that securely clamps a flat belt to the pulley, the pulley comprising:

a two-piece hub having a center shaft hole with a center axis that defines mutually perpendicular axial and radial directions relative to the pulley, the hub having a cylindrical peripheral surface and first and second circular side surfaces on axially opposite sides of the peripheral surface, and the hub having a two-piece construction including a first piece with a first clamping surface and a second piece with a second clamping surface where the first clamping surface and the second clamping surface oppose each other with the belt there between when securely clamping the belt to the pulley;

at least two adjustable fasteners connecting the hub first piece to the hub second piece with the first and second clamping surfaces opposing each other, the adjustable fasteners enabling selective movement of the first and second clamping surfaces toward each other to securely clamp the belt between the first and second clamping surfaces and enabling movement of the first and second clamping surfaces away from each other to release the belt from between the first and second surfaces, the at least two adjustable fasteners being positioned on axially opposite sides of the belt when the belt is securely clamped between the first and second clamping surfaces;

a first circular flange removably secured to the hub first side surface, the first flange having a circular peripheral surface that is spaced radially outward from the hub peripheral surface;

a second circular flange removably secured to the hub second side surface, the second flange having a circular peripheral surface that is spaced radially outward from the hub peripheral surface;

the first flange having a circular cavity defined by a cylindrical side wall recessed into one side of the first flange, the hub first side surface being positioned in the first flange cavity with the cavity side wall extending around and being positioned in a same radial plane as a first adjustable fastener of the at least two adjustable fasteners; and, the second flange having a circular cavity defined by a cylindrical side wall recessed into one side of the second flange, the hub second side surface being positioned in the second flange cavity with the cavity side wall extending around and being positioned in a same radial plane as a second adjustable fastener of the at least two adjustable fasteners.

7. A flat belt pulley that securely clamps a flat belt to the pulley, the pulley comprising:

a two-piece hub having a center shaft hole with a center axis that defines mutually perpendicular axial and radial directions relative to the pulley, the hub having a cylindrical peripheral surface and first and second circular side surfaces on axially opposite sides of the peripheral surface, and the hub having a two-piece construction including a first piece with a first clamping surface and a second piece with a second clamping surface where the first clamping surface and the second clamping surface oppose each other with the belt there between when securely clamping the belt to the pulley;

at least two adjustable fasteners connecting the hub first piece to the hub second piece with the first and second clamping surfaces opposing each other, the adjustable fasteners enabling selective movement of the first and second clamping surfaces toward each other to securely clamp the belt between the first and second clamping surfaces and enabling movement of the first and second clamping surfaces away from each other to release the belt from between the first and second surfaces, the at least two adjustable fasteners being positioned on axially opposite sides of the belt when the belt is securely clamped between the first and second clamping surfaces;

a first circular flange removably secured to the hub first side surface, the first flange having a circular peripheral surface that is spaced radially outward from the hub peripheral surface;

a second circular flange removably secured to the hub second side surface, the second flange having a circular peripheral surface that is spaced radially outward from the hub peripheral surface;

the first flange having opposite exterior and interior surfaces;

the second flange having opposite exterior and interior surfaces;

the first flange interior surface and the second flange interior surface extending radially outwardly from the hub peripheral surface and opposing each other across the hub peripheral surface;

a first adjustable fastener of the at least two adjustable fasteners being positioned on the hub first and second pieces where a center axis of the first adjustable fastener is positioned axially between the first flange exterior and interior surfaces; and, a second adjustable fastener of the at least two adjustable fasteners being positioned on the hub first and second pieces where a center axis of the second adjustable fastener is positioned axially between the second flange exterior and interior surfaces.

8. A flat belt pulley that securely clamps a flat belt to the pulley, the pulley comprising:

a two-piece hub having a center shaft hole with a center axis that defines mutually perpendicular axial and radial directions relative to the pulley, the hub having a cylindrical peripheral surface and first and second circular side surfaces on axially opposite sides of the peripheral surface, and the hub having a two-piece construction including a first piece with a first clamping surface and a second piece with a second clamping surface where the first clamping surface and the second clamping surface oppose each other with the belt there between when securely clamping the belt to the pulley;

a first circular flange removably secured to the hub first side surface, the first flange having a circular peripheral surface that is spaced radially outward from the hub peripheral surface, the first flange having a circular cavity recessed into one side of the first flange, the first flange cavity having a cylindrical side wall that extends around the first flange cavity, the hub first side surface being positioned in the first flange cavity with the side wall of the first flange cavity extending around a portion of the hub peripheral surface on one side of the belt when the belt is clamped to the pulley;

a second circular flange removably secured to the hub second side surface, the second flange having a circular peripheral surface that is spaced radially outward from the hub peripheral surface, the second flange having a circular cavity recessed into one side of the second flange, the second flange cavity having a cylindrical side wall that extends around the second flange cavity, the hub second side surface being positioned in the second flange cavity with the side wall of the second flange cavity extending around a portion of the hub peripheral surface on an opposite side of the belt from the first flange when the belt is clamped to the pulley;

a first adjustable fastener on the hub connecting the hub first and second pieces, the first fastener being positioned at least partially within the first flange cavity; and, a second adjustable fastener on the hub connecting the hub first and second pieces, the second fastener being positioned at least partially within the second flange cavity.

9. The pulley of claim 8, further comprising:

the first fastener extending through both the first and second clamping surfaces; and, the second fastener extending through both the first and second clamping surfaces.

10. The pulley of claim 8, further comprising:

the first fastener being positioned axially to one side of the belt when the belt is clamped to the pulley; and, the second fastener being positioned axially to an opposite side of the belt from the first fastener when the belt is clamped to the pulley.

11. A flat belt pulley that securely clamps a flat belt to the pulley, the pulley comprising:

a two-piece hub having a center shaft hole with a center axis that defines mutually perpendicular axial and radial directions relative to the pulley, the hub having a cylindrical peripheral surface and first and second circular side surfaces on axially opposite sides of the peripheral surface, and the hub having a two-piece construction including a first piece with a first clamping surface and a second piece with a second clamping surface where the first clamping surface and the second clamping surface oppose each other with the belt there between when securely clamping the belt to the pulley;

a first circular flange removably secured to the hub first side surface, the first flange having a circular peripheral surface that is spaced radially outward from the hub peripheral surface, the first flange having a circular cavity recessed into one side of the first flange, the first flange cavity having a cylindrical side wall that extends around the first flange cavity, the hub first side surface being positioned in the first flange cavity with the side wall of the first flange cavity extending around a portion of the hub peripheral surface on one side of the belt when the belt is clamped to the pulley;

a second circular flange removably secured to the hub second side surface, the second flange having a circular peripheral surface that is spaced radially outward from the hub peripheral surface, the second flange having a circular cavity recessed into one side of the second flange, the second flange cavity having a cylindrical side wall that extends around the second flange cavity, the hub second side surface being positioned in the second flange cavity with the side wall of the second flange cavity extending around a portion of the hub peripheral surface on an opposite side of the belt from the first flange when the belt is clamped to the pulley;

a first adjustable fastener on the hub connecting the hub first and second pieces, the first fastener having a center axis that is positioned entirely within the first flange cavity; and, a second adjustable fastener on the hub connecting the hub first and second pieces, the second fastener having a center axis that is positioned entirely within the second flange cavity.

12. The pulley of claim 11, further comprising:

the first fastener extending through both the first and second clamping surfaces; and, the second fastener extending through both the first and second clamping surfaces.

13. The pulley of claim 11, further comprising:

the first fastener being positioned axially to one side of the belt when the belt is clamped to the pulley; and, the second fastener being positioned axially to an opposite side of the belt from the first fastener when the belt is clamped to the pulley.

14. A flat belt pulley that securely clamps a flat belt to the pulley, the pulley comprising:

a two-piece hub having a center shaft hole with a center axis that defines mutually perpendicular axial and radial directions relative to the pulley, the hub having a cylindrical peripheral surface and first and second circular side surfaces on axially opposite sides of the peripheral surface, and the hub having a two-piece construction including a first piece with a first clamping surface and a second piece with a second clamping surface where the first clamping surface and the second clamping surface oppose each other with the belt there between when securely clamping the belt to the pulley;

a first hub cavity recessed axially into the first side surface of the hub, the first hub cavity having a side wall that extends around the first hub cavity;

a second hub cavity recessed axially into the second side surface of the hub, the second hub cavity having a side wall that extends around the second hub cavity;

a first adjustable fastener on the hub, the first fastener connecting the hub first and second pieces, the first fastener having a head positioned in the first hub cavity with the first fastener extending through the first hub cavity side wall and the first and second clamping surfaces; and, a second adjustable fastener on the hub, the second fastener connecting the hub first and second pieces, the second fastener having a head positioned in the second hub cavity with the second fastener extending through the second hub cavity side wall and the first and second clamping surfaces.

15. The pulley of claim 14, further comprising:

the first fastener being positioned axially to one side of the belt when the belt is clamped to the pulley; and, the second fastener being positioned axially to an opposite side of the belt from the first fastener when the belt is clamped to the pulley.

16. The pulley of claim 14, further comprising:

the first fastener having a center axis that is perpendicular to the hub center axis; and, the second fastener having a center axis that is perpendicular to the hub center axis.

17. The pulley of claim 16, further comprising:

the first fastener center axis and the second fastener center axis being positioned axially between the first and second side surfaces of the hub.

18. The pulley of claim 16, further comprising:

a first, straight groove in the first side surface of the hub, the first groove being aligned with the first fastener center axis; and, a second, straight groove in the second side surface of the hub, the second groove being aligned with the second fastener center axis.

19. The pulley of claim 14, further comprising:

a rod extending axially through the hub;

the first fastener extending through the rod; and, the second fastener extending through the rod.

20. The pulley of claim 14, further comprising:

a first circular flange removably secured to the hub first side surface, the first flange having a circular peripheral surface that is spaced radially outward from the hub peripheral surface; and, a second circular flange removably secured to the hub second side surface, the second flange having a circular peripheral surface that is spaced radially outward from the hub peripheral surface.

21. The pulley of claim 20, further comprising:

the first flange having a first hole through the first flange that communicates with and provides access to the first hub cavity; and, the second flange having a second hole through the second flange that communicates with and provides access to the second hub cavity.

* * * * *